US005460116A

United States Patent [19]

György; László

[11] Patent Number: 5,460,116

[45] Date of Patent: Oct. 24, 1995

[54] HORN FOR SPORTFANS

[76] Inventor: László György, H-2013 Pomáz, Széchenyi u. 19, Hungary

[21] Appl. No.: 232,187

[22] PCT Filed: Oct. 30, 1992

[86] PCT No.: PCT/HU92/00043

§ 371 Date: Apr. 28, 1994

§ 102(e) Date: Apr. 28, 1994

[87] PCT Pub. No.: WO93/09530

PCT Pub. Date: May 13, 1993

[30] Foreign Application Priority Data

Oct. 30, 1991 [HU] Hungary ..... 34 09/91

[51] Int. Cl.[6] ..... G10K 9/04

[52] U.S. Cl. ..... 116/142 FP; 116/142 R

[58] Field of Search ..... 116/142 FP, 142 R, 116/142 FV, 138, 59

[56] References Cited

U.S. PATENT DOCUMENTS

| | | | |
|---|---|---|---|
| 870,074 | 11/1907 | Astrom | 116/142 FP |
| 1,655,675 | 1/1928 | Cunningham | 116/142 FP |
| 1,679,011 | 7/1928 | Widmyer | 116/142 FP |
| 2,918,895 | 12/1959 | Buell | 116/142 FP |
| 4,686,928 | 8/1987 | Weisenberger | 116/137 R |
| 4,706,295 | 11/1987 | Putnam | 381/156 |
| 4,970,983 | 11/1990 | LeBlanc et al. | 116/142 FP |

FOREIGN PATENT DOCUMENTS

| | | |
|---|---|---|
| 397440 | 8/1933 | Belgium . |
| 0337067A2 | 2/1989 | European Pat. Off. . |
| 426415 | 1/1925 | Germany . |
| 9202120 | 5/1992 | Germany . |
| 9211343 | 3/1993 | Germany . |
| 9364 | of 1912 | United Kingdom . |
| 2077019 | 12/1981 | United Kingdom . |
| WO88/03744 | 5/1988 | WIPO . |

*Primary Examiner*—William A. Cuchlinski, Jr.
*Assistant Examiner*—Willie Morris Worth
*Attorney, Agent, or Firm*—Herbert Dubno

[57] ABSTRACT

A horn for producing sound at a sporting event or festival has a sound tube coaxially surrounded by a pressure tube with a minimum clearance of 0.2 mm therebetween, a membrane being stretched over the ends of the two tubes and held by a retaining ring under tension. The tubes are held together at the opposite ends by a closing collar which closes the annular clearance and a hole is provided in the pressure tube substantially midway between its ends.

2 Claims, 1 Drawing Sheet

HORN FOR SPORTFANS

CROSS REFERENCE TO RELATED APPLICATION

This application is a national phase of PCT/HU92/00043 filed 30 Oct. 1992 and based, in turn, on Hungarian national application 3409/91 filed 30 Oct. 1991 under the International Convention.

FIELD OF THE INVENTION

The present invention relates to a sport horn provided with a pressure tube, a membrane and a sound tube, wherein both the pressure tube and the sound tube are in connection with said membrane.

BACKGROUND OF THE INVENTION

The horns of the art produce a sound by the membrane, which is vibrated by a pressure fluid, generally air. Such horns are generally used as ship horns or sirens in factories etc. Accordingly, they are generally of considerable dimensions and weight, thus a relatively high pressure is needed for producing a very strong sound.

The Hungarian patent 89 973, 95 819, 98 353, 100 289 and 101 300 all disclose such horns. The membranes of these horns are of metal sheets and are prestressed. The pipe introducing the pressure fluid is always arranged at the central part of the membrane, meanwhile a sound tube or horn is coaxial with the pressure tube and the end thereof bearing the membrane is arranged around the pressure tube.

On the other hand, people at sporting events, (for instance football matches) or festivals often use horns made of paper.

These horns produce, however, a rather poor sound.

OBJECT OF THE INVENTION

The object of the present invention is therefor to provide a horn, which is small, light and of simple construction, but is able to produce a considerable sound, when blown by the mouth.

SUMMARY OF THE INVENTION

Accordingly, the present invention provides to a horn having a pressure tube, a membrane and a sound tube, wherein both the pressure tube and the sound tube are in connection with said membrane. According to the invention the membrane is stretched out on the front face of the pressure tube, the sound tube is arranged within and coaxial with the pressure tube and its front face rests flat against the central part of the membrane. An annular air gap is arranged between the outer surface of the sound tube and the inner surface of the pressure tube, said gap being closed at the end opposite to the membrane and there is a sound hole in the wall of the pressure tube.

Both the pressure tube and the sound tube are straight tubes arranged coaxially. The end part of the pressure tube may have a diameter at the membrane, which is greater than that of the other end part.

The thickness of the membrane is preferably between 0,01 and 2 mm and is a plastic foil.

The sound tube may be provided with one or more extension tubes. The width of the air gap is preferably at least 0,2 mm, meanwhile the diameter of the sound hole is preferably between 0,2 and 50 mm.

The invention is based on the recognition that a very strong sound may be produced, when a rather thin and elastic membrane is applied and a pressure fluid is guided to the outer annular part of the membrane instead of the central part thereof. In this way, the membrane may be vibrated easily and the produced sound is rather strong.

BRIEF DESCRIPTION OF THE DRAWING

Further details and advantages of the present invention will be explained by way of an example with reference to the accompanying drawing, the sole Figure of which is an axial section of the horn.

SPECIFIC DESCRIPTION

Figure 1:
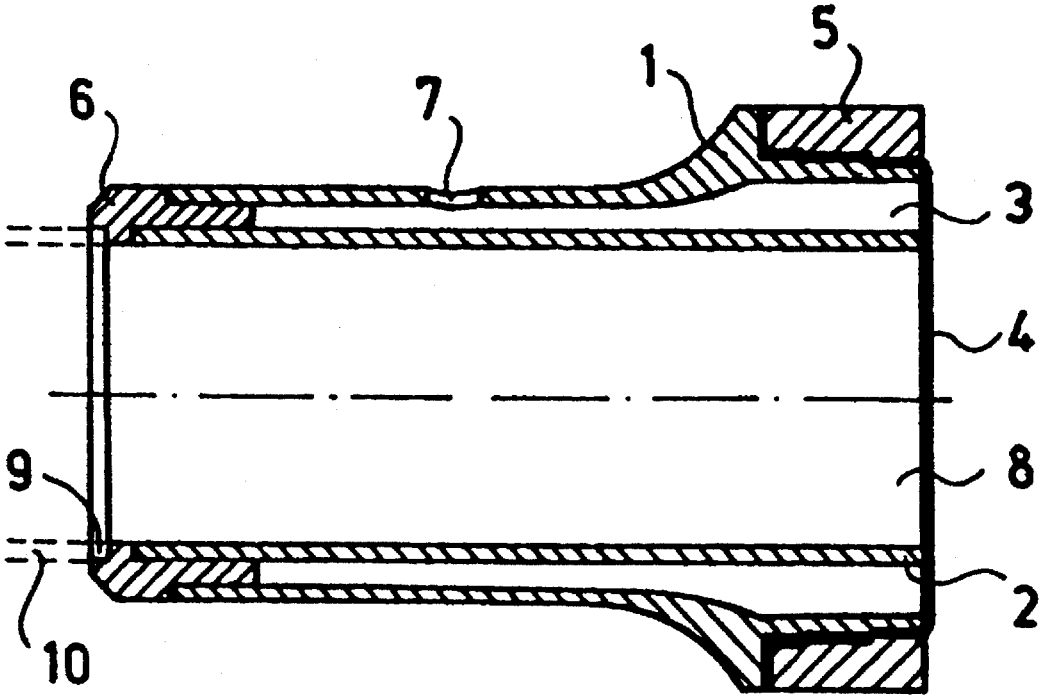

The horn according to the drawing consists of a pressure tube 1, a sound tube 2, a membrane 4, a retainer ring 5 and a locking collar 6.

All the tubes and rings are cylindrical and coaxial. Instead of locking collar 6, the pressure tube 1 and/or the sound tube 2 may be provided with an appropriate flange for closing the space between pressure tube 1 and sound tube 2. This space, which is actually an air gap 3, is closed on the other end of the horn by membrane 4.

The membrane 4 is stretched out on the front faces of pressure tube 1 and sound tube 2 and is hold by retainer ring 5. The membrane 4 is stretched out in order to be prestressed, when fixed by the retainer ring 5.

The end of sound tube 2 opposite to the membrane 4 is open and pressure tube 1 is provided with a sound hole 7.

The space within the sound tube 2, limited by the membrane 4 on the one side and open on the other side acts as sound generating chamber 8. The volume of the sound generating chamber 8 may be enlarged by extension tubes 10 fitted into the shoulder 9 of the locking collar 6.

The measures of the horn are defined by the intended use on the one hand and by well-known acoustic correlations on the other hand.

The embodiment shown in the drawing is constructed for amusement at football or hockey matches. Accordingly, the length of the whole device is about 100 mm, the outer diameter is about 50

The membrane is a polyethylene foil of about 0,05 mm thickness. The sound hole has a diameter of 10 mm.

The above device prooved to be a very effective horn producing a surprisingly strong sound.

The sound is produced similarly to the usual horns, which means that the air under pressure arrive at the membrane 4 and a vibration takes place. That produces a sound effect amplified by the sound tube 2. The only difference, which goes with a considerable increase in the sound producing effect is that the fluid (air under pressure) arrives at the membrane around the sound tube, at the periphery of the membrane. Due to this effective sound producing situation, a relatively small and thin membrane is suitable for a rather strong sound effect.

In order to change the frequency of the sound produced by the device according to the invention, one or more extension tubes 10 can be attached to the basic device. The first extension tube 10 is seated in the shoulder 9 of the closing collar 6 and the next one in the shoulder of the previous tube.

All the shoulders 9 are preferably constructed in a way that the extension tubes 10 would fall out at a rather low side force. In this way, the use of the device as a weapon is impossible.

The device shown in the drawing is of course only an illustration of the invention and it is generally not intended to be restricted in the scope of protection by the example given above. The horn may have different shapes, the thickness of the membrane may be between 0,01 and 2 mm and its material can also be polypropylene, cellophane, rubber, etc.

I claim:

1. A horn for producing a sound at a sporting event or festival, comprising:

an elongated cylindrical sound tube of constant thickness having and inlet end and an outlet end;

an elongated pressure tube coaxially surrounding said sound tube and defining an all-around clearance therewith of a thickness of at least 0.2 mm over most of lengths of said tubes, said pressure tube having a first end at said inlet end and a second end lying in a common plane with said outlet end and of a diameter greater than that of said first end;

a membrane of a thickness of 0.01 to 2 mm and composed of polyethylene, polypropylene, cellophane or rubber spanned under tension across both said outlet end and said second end;

a retainer ring surrounding said second end, terminating at said plane and clamping said membrane around an exterior thereof;

a sound hole formed in said pressure tube substantially midway between said first and second ends and communicating between said clearance and the exterior of said horn, said sound hole having a diameter of 0.2 to 50 mm; and a closing collar secured to said inlet end of said sound tube and said first end of said pressure tube and closing an end of said clearance.

2. The horn defined in claim 1 wherein said collar is formed with an annular shoulder, further comprising an extension tube fitted in said collar against said shoulder and extending said pressure tube.

* * * * *